US005408717A

United States Patent [19]

Wenzer

[11] Patent Number: 5,408,717

[45] Date of Patent: Apr. 25, 1995

[54] TOOTHBRUSH WITH DOME

[76] Inventor: Kenneth C. Wenzer, 11538 February Cir., #402, Silver Spring, Md. 20904

[21] Appl. No.: 209,898

[22] Filed: Mar. 14, 1994

[51] Int. Cl.[6] ..... A46B 9/04

[52] U.S. Cl. ..... 15/167.1; 15/159.1; 15/160

[58] Field of Search ..... 15/159.1, 160, 167.1, 15/186, 187, 192, 193

[56] References Cited

U.S. PATENT DOCUMENTS

| | | | |
|---|---|---|---|
| 639,376 | 12/1899 | Goehring | 15/159.1 |
| 1,160,370 | 11/1915 | Bradshaw | 15/193 |
| 1,265,237 | 5/1918 | Morrison | 15/192 |
| 1,476,519 | 12/1923 | Karl | 15/167.1 |
| 1,889,495 | 11/1932 | Priest | 15/167.1 |
| 2,066,772 | 1/1937 | Doyle | 15/167.1 |
| 2,306,482 | 12/1942 | Livingston | 15/167.1 |
| 3,792,504 | 2/1974 | Smith | 15/167.1 |
| 5,150,494 | 9/1992 | Wenzer | 15/159.1 |

*Primary Examiner*—David A. Scherbel
*Assistant Examiner*—Randall E. Chin
*Attorney, Agent, or Firm*—Robert Halper

[57] ABSTRACT

A tooth brush having a head with a hard,dome shaped, machinable plastic segment extending upwardly from said head, with arrays of tufts of bristles therein, said arrays of bristles vertically oriented to present a flat upper surface.

4 Claims, 1 Drawing Sheet

TOOTHBRUSH WITH DOME

BACKGROUND OF THE INVENTION

1. Field of the Invention

This invention pertains to tooth brushes and is only incidentally concerned with a structure that facilitates teeth cleaning. Rather the purpose of the invention is to fit the tooth brush with a device that enables cleaning of the tooth brush per se. It is well established that the everyday tooth brush is a breeding ground for bacteria, viruses and yeasts.

2. Description of the Prior Art

A study of the prior art shows a variety of toothbrushes that have curved surfaces somewhat similar to the dome shaped structure of the applicant; however, all of the aforesaid tooth brushes are concerned with a shaped tooth brush that facilitates teeth cleaning and are not concerned with a structure that enables the brush to be cleaned.

U.S. Pat. No. 1,452,108 shows a widened oval head portion 3 in which tufts of bristles 4 are anchored. The object of the invention is the production of a brush construction which is adpated for simultaneously cleansing the teeth and massaging the gums. The holes for placement of the bristles are sufficiently separated so that the tufts are self cleansing. The oval shaped head is planar.

U.S. Pat. No. 1,913,990 is an example of a tooth brush that emphasizes a construction designed to facilitate teeth brushing. Circular rows of holes 8 are formed in a rounded head portion 2 having a flat back 5 and a front convex surface 9 for anchoring bristles 4. The holes are bored perpendicular to a tangent to the curved surface. Since the bristles are substantially the same height, then their outer extremities are of the same curvature as the head so that each tuft of bristles is supported with the same rigidity. Therefore each tuft of bristles is prohibited from interfering with other tufts during the brushing. Brushing is supposed to be accomplished by an improved vertical motion from the jaws to the teeth. As the brush is designed for brushing by a vertical motion in view of its shape, the angle of the handle may be moved from vertical to horizontal without changing the relative position of the brush on the teeth.

U.S. Pat. No. 2,864,111 is an example of a toothbrush adapted to assume one of at least two different configurations according to the user's preference. The toothbrush can be flat as in FIG. 1 or convex as shown in FIG. 2 or FIG. 9. To make the toothbrush convex a tongue portion 9 of flexible rod 8 is pushed forward by the thumb until the rear end has slid off the shoulder 10 and then snaps down into the abutting portion shown in FIG. 2, the rod sticking into the dovetail groove 2 of member 1. In FIG. 9 the bristles are inserted into the strip 8 to have slightly converging relationship in the flat condition so as to compensate for divergence when the strip is bent in a convex arcuate shape. Thus the bristles will be parallel when the strip is bent.

U.S. Pat. No. 3,822,434 pertains to a shaving brush 30 having heating means for lather. The bristles 36 of the brush are arranged in tufts 40 in an annular array to provide a barrel 44 for receiving the lather. There are a plurality of apertures 42 at the lower end of the barrel to assure thorough rinsing after use. The brush has an electrical heating apparatus 46 which heats the lather in the barrel. The heating apparatus has a cylinder 48 mounted in the handle and includes a domed portion which is heated and in turn heats the lather.

U.S. Pat. No. 4,081,877 is a massaging device 10 with a toothbrush head insert on one end. The insert 24 comprises a flexible element having a longitudinally aligned row of resilient conically shaped massage elements 26 affixed to the upper surface of a rounded element 34. The purpose is to provide utility in removing trapped particles between the teeth and when a lateral massaging motion is imparted to the device, the conical elements communicate with the base so that the gums are stimulated and massaged.

U.S. Pat. No. 4,888,844 teaches a toothbrush for multi-purposes for cleaning and brushing natural teeth or dentures. An enlarged bulbous member 18 has a flat smooth surface 22 and a curved surface 24. FIG. 2 shows a large number of bristles which are the same shape as the bulbous member. Where the two aforementioned surfaces meet, angled edges 31 occur. In normal use surfaces 32 and 34 are preferable. When cleaning dentures, the fairly sharp edges 36 and rounded ends 38 are also available.

U.S. Pat. No. 5,024,796 is a gum massager having cleaning and massaging abilities that can reach the gums between the teeth as well as other gum areas. The device comprises a half cylindrical shaped head having sturdy, relatively short closely packed nodules. A plastic handle 12 has a neck portion 14 attached to the head support 18. The head 20 is made of soft rubber and is attached to the support with two end portion 22 and a half cylindrical outer surface 24 with many closely packed soft sturdy nodules on its outer surface.

U.S. Pat. No. 5,150,494 is applicant's prior patent and is drawn to a paint brush having a plastic dome through which the bristles extend to be embedded in a ferrule. It has been found that paint after painting has a tendency to settle at the base of the bristles in a dome like fashion after awhile and despite cleaning after use the bristles become stiff and deteriorate. By placing a hard plastic dome, which might be described as having a turtle shape, interposed between the ferrule and the bristle ends that would normally enter the ferrule, the paint that settles will come to rest on the dome surface from which it can be readily removed, thus prolonging the life of the brush.

Up till the advent of applicant's invention, the method of cleaning toothbrushes involved the use of chemicals. This invention offers a viable mechanical alternative to chemical cleaning.

SUMMARY OF THE INVENTION

The toothbrush of this invention employs a plastic dome interposed between tufts of bristles that nest in the base of the toothbrush and the top surface of the base, The bristles are rigidly implanted in the dome and extend to the top of the base of the toothbrush, but need not be embedded therein. The bristles are all of the same height so that the top surface of the bristles are both coincident and parallel to each other. The purpose of the dome is to facilitate cleaning of the brush by simply brisk rinsing with a stream of water such as from a tap. It is known that after a short period of use the toothbrush will accumulate a variety of products such as residual toothpaste, cellular tissue and plaque. The products tend to collect at the base of the brush where the bristles enter and are difficult to remove despite rinsing and spacing the tufts of bristles to improve cleansing as suggested by the prior art. That this is so, is noted by the recommendation of the American Dental Association that toothbrushes be replaced after about 3–4 months. The telltale signs for replacement of a toothbrush are frayed or bent bristles and toothpaste clogged around the bristle base. While this invention cannot alleviate the problem of wear of the bristles, it does offer a simple solution for improving the hygienic condition of the toothbrush by removal of germs that tend to collect in the bristles. The primary purpose of the toothbrush is to remove plaque. Plaque is a colorless sticky film composed of colonies of bacteria that attaches to the tooth. Left unattended, the plaque hardens and becomes a calculus. If the plaque is not removed, it can cause gingivitis as well as other problems. The more effectively the teeth are brushed, the more plaque that is removed. Even though the toothbrush is rinsed, some of the plaque removed from the teeth will collect like toothpaste around the bristle base. By placing a dome between the base and the bristle ends adjacent thereto, collection of toothpaste, plaque and any other substances at the base is eliminated. While such materials might settle on the dome, it is much easier to remove them from a brush having a hard convex surface with all the bristles arranged parallel and coincident than with a flat surfaced brush or with a brush where the bristles assume the curvature of the surface in which they are embedded. Of course, even if a toothbrush were not used but reposed in its appointed place open to the atmosphere, it would still accumulate airborne germs from the hostile environment of the bathroom. This invention is incidentally concerned with airborne germs only so far as such germs might accumulate at the base of the brush. To combat airborne germs, it has been suggested to use a germicide spray or to cover the brush with a hood.

DESCRIPTION OF THE PREFERRED EMBODIMENT

Figure 1:
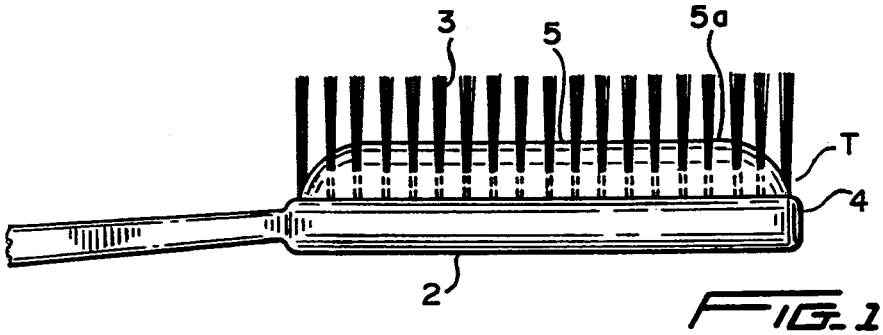
FIG. 1 is a side view of the toothbrush.
Figure 2:
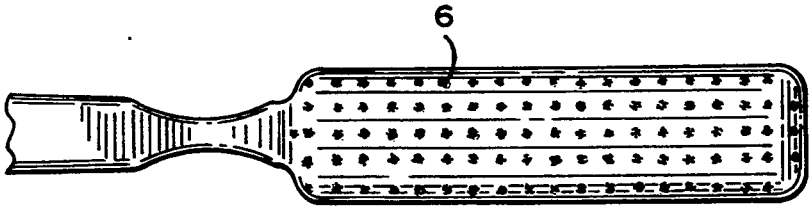
FIG. 2 is a plan view as seen from the top.
Figure 3:
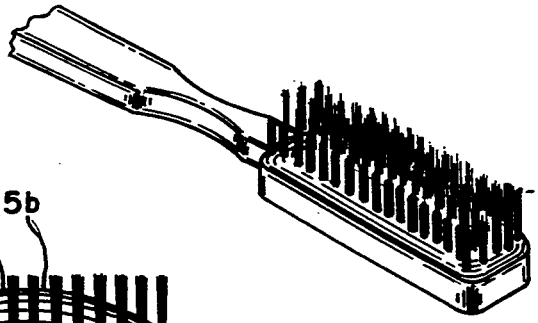
FIG. 3 is a perspective view of the tooth brush.
Figure 4:
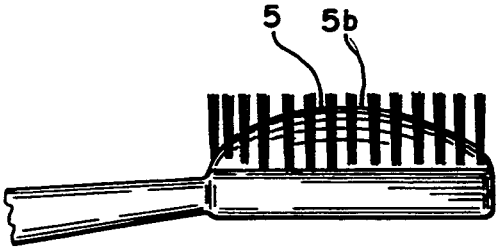
FIG. 4 is a side view showing a tooth brush with a different shaped dome.
Figure 5:
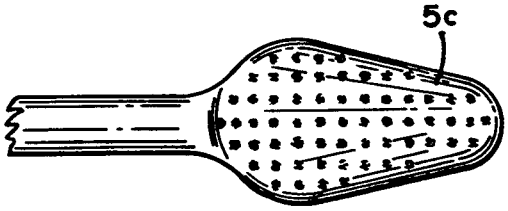
FIG. 5 is a view showing an alternative embodiment of a different shaped dome for a tooth brush having a different configuration.
Figure 6:
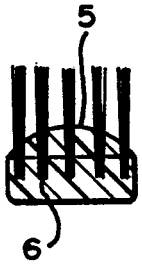
FIG. 6 is a view showing an alternative structure for placing the bristles.

FIG. 1 depicts a toothbrush T having a handle 1 and a head 2 for the bristles 3 connected to the handle. The handle is any one of a conventional type having rounded ends and a reduced portion adjacent the head. The toothbrush has a base 4 which is flat from end to end. The width of the head may vary from slightly smaller than the handle to slightly wider. Similarly the length may vary from about 6¼ inches to 7 inches. Affixed to the head and of the same width is a hard, machinable, plastic domeshaped segment 5. The dome extends the length and width of the head and is rounded at both ends as seen in FIG. 2. The dome may vary in shape from semi-ellipsoidal 5*a* as in FIG. 1 to semi-cylindrical 5*b* as in FIG. 4. If the tooth brush has a different configuration than the standard brush, the dome can vary accordingly as shown in FIG. 5. The height of the dome at its peak will be about 3/16 inch. As seen in FIGS. 1 and 2 the bristles are mounted in the dome. This procedure is done by boring holes 6 and placing an array of tufts of bristles 3 in each hole or as shown in FIG. 6 the holes are bored in the head of the brush and the tufts are placed therein. The tufts are held rigid in the holes by sealing with an epoxy resin. The bristle tufts extend completely through the dome and rest on the top surface of the head as shown in FIG. 4 or the bristles can extend through the dome and be embedded in the head of the brush in the conventional manner. The average height of bristle tufts from the top surface of the head to the top of the bristles is about ½ inch. Consequently the height of the bristles will always be above the height of the dome even at its peak. Accordingly every other tuft embedded in the different heights of the dome will be fashioned so that its height will be both parallel and in alignment with with the tuft extending from the peak, with the upper surface of the brush being flat. In general the tufts will be arrayed in about three or four rows with about a dozen tufts in each row as is conventional. The plastic for the dome is any one of a number of thermosetting plastics such as a polyester. Notwithstanding the fact that many of the patents cited show the bristles taking the convex shape of the head in which they are mounted, the recommended toothbrush should have a flat brushing surface as well as a soft round ended bristles and a straight handle. (See Enclosure) Nevertheless, because some toothbrushes have different configurations, FIG. 5 is a representation of a dome 5*c* having a configuration that conforms to the shape of the toothbrush. The cleaning of the brush can still be effectuated in the manner as heretofor described.

While the invention has been described in some detail above, it is to be understood that many modifications may be made without departing from the spirit of the invention as expressed by the scope of the claims.

I claim:

1. A toothbrush comprising a first end and a second end, said toothbrush having a handle and a head, said head being connected to said handle, said head being spaced at a horizontal distance from said handle, said toothbrush being designed to eliminate accumulation of toothpaste and plaque from the environment at said head, said head having an upper surface having bored holes therein, said upper surface having affixed thereto a hard, dome shaped machinable plastic segment, said dome shaped segment extending the width and length of said head, arrays of tufts of bristles extending from said upper surface of said head upwardly and vertically through said dome to present a substantially planar brushing surface, said tufts of bristles (extend) extending downwardly from said planar brushing surface through said dome and (are) being embedded in said holes in said head and sealed with an epoxy resin adhesive.

2. A toothbrush as in claim 1 wherein the dome is in the shape of a semi-ellipsoid.

3. A toothbrush as in claim 1 wherein the dome is in the shape of a semi-cylinder.

4. A toothbrush as in claim 1 wherein said plastic is a thermosetting plastic (such as a polyester) and said height of said dome at (it) its peak is 3/16 (said height of) said tufts of bristles extending (above said peak) to a height of about ½" from said upper surface of said head above said dome so as to be parallel and in alignment with each other.

* * * * *